US005740745A

United States Patent [19]

Smyrniotis et al.

[11] Patent Number: 5,740,745

[45] Date of Patent: Apr. 21, 1998

[54] PROCESS FOR INCREASING THE EFFECTIVENESS OF SLAG CONTROL CHEMICALS FOR BLACK LIQUOR RECOVERY AND OTHER COMBUSTION UNITS

[75] Inventors: Christopher R. Smyrniotis, Syracuse, N.Y.; William F. Michels, Aurora, Ill.; M. Damian Marshall, Chicago, Ill.; William H. Sun, Naperville, Ill.; Daniel V. Diep; Cari M. Chenanda, both of Aurora, Ill.

[73] Assignee: Nalco Fuel Tech, Naperville, Ill.

[21] Appl. No.: 710,630

[22] Filed: Sep. 20, 1996

[51] Int. Cl.[6] ..... F23B 7/00

[52] U.S. Cl. ..... 110/343; 110/238; 122/401; 162/30.11

[58] Field of Search ..... 110/343, 188–190, 110/238; 122/390, 401; 162/30.11

[56] References Cited

U.S. PATENT DOCUMENTS

| | | | |
|---|---|---|---|
| 3,800,466 | 4/1974 | Heit . | |
| 4,159,683 | 7/1979 | Hughes et al. . | |
| 4,513,256 | 4/1985 | Kober et al. | 162/30.11 |
| 4,514,256 | 4/1985 | Kober et al. . | |
| 4,616,574 | 10/1986 | Abrams et al. | 110/343 |
| 4,903,642 | 2/1990 | Tamaru et al. | 122/401 |
| 5,113,802 | 5/1992 | Le Blanc . | |
| 5,288,857 | 2/1994 | Aarsrud et al. . | |
| 5,551,354 | 9/1996 | Crofut et al. | 110/238 |

OTHER PUBLICATIONS

Michels, et al, The Application of Computational Fluid Dynamics in the NOxOUT Process for Reducing NOx Emissions from Stationary Combustion Sources, American Flame Research Comm. 1990 Fall International Symposium, San Francisco, CA, 10790.

*Primary Examiner*—Henry A. Bennett
*Assistant Examiner*—Susanne C. Tinker
*Attorney, Agent, or Firm*—St. Onge Steward Johnston & Reens LLC

[57] ABSTRACT

Reduction of slagging is improved by targeting slag-reducing chemicals in a furnace with the aid of computational fluid dynamic modeling. Chemical utilization and boiler maintenance are improved.

10 Claims, 2 Drawing Sheets

PROCESS FOR INCREASING THE EFFECTIVENESS OF SLAG CONTROL CHEMICALS FOR BLACK LIQUOR RECOVERY AND OTHER COMBUSTION UNITS

DESCRIPTION

1. Technical Field

The invention relates to improving the effectiveness of chemicals introduced into the fire side of black liquor recovery and other boilers for the purpose of reducing hot-side slagging, plugging and/or corrosion.

In the paper industry, literally tons of black liquor are produced and must be reduced in a furnace to provide digestion chemical feed stock or disposed of in the most economical and environ-mentally benign manner. This liquor has a relatively high heat value and is a source of recoverable chemicals. It has been found that it can be burned in concentrated aqueous form. The combustion process produces sodium and potassium salts of sulfate, chloride, oxygen and others, that in combination have relatively low melting points (e.g., 1000°–1800° F.) that impact and solidify on heat exchange and other surfaces in the hot end of the boilers. These deposits (slagging) are often corrosive and extremely difficult to remove by conventional techniques such as soot blowing. Their buildup results in a loss of heat transfer throughout the system, increases draft loss and limits gas throughput.

The art has endeavored to solve the slagging problem by the introduction of various chemicals, such as magnesium oxide or hydroxide. Magnesium hydroxide has the ability to survive the hot environment of the furnace and react with the deposit-forming compounds, raising their ash fusion temperature and thereby modifying the texture of the resulting deposits. Unfortunately, the introduction of the chemicals has been very expensive due to poor utilization of the chemicals, much simply going to waste and some reacting with hot ash that would not otherwise cause a problem.

There is a need for an improved process which could achieve highly effective, reliable treatments with reduced chemical consumption.

2. Background Art

A variety of procedures are known and typically add treatment chemicals, such as magnesium oxide and magnesium hydroxide, to the fuel or into the furnace in quantities sufficient to treat all of the ash produced, in the hope of solving the slagging problem.

In U.S. Pat. No. 4,159,683, sodium bentonite is added directly to the furnace in an amount of up to about 5% by weight of a waste material such as black liquor.

In U.S. Pat. No. 4,514,256, the use of materials that tend to react with the sodium sulfide content of a black liquor. Suitable substances include sodium persulfate, manganese dioxide, cupric oxide and ferric oxide. The disclosure indicates that the material is preferably introduced into the furnace dry to contact the portions where slag would tend to build up. The use of slurries is mentioned, but not preferred, and there is no indication of how to reach, preferentially, the particular problem areas. It is shown in applicants' Examples, however, that computer modeling can be effective in providing targeted injection when used in conjunction with slurries, e.g., of magnesium hydroxide, with dilution water to control droplet size and velocity assure that a target area is effectively treated.

In U.S. Pat. No. 5,288,857, calcium is introduced into black liquor or at an earlier stage in processing. As with the other procedures, reagent usage tends to be very high.

1. Disclosure of Invention

It is an object of the invention to improve the introduction of fireside chemical additives into black liquor recovery boilers to achieve highly effective, reliable treatments with reduced chemical consumption.

It is another object of the invention to improve the reliability of fireside chemical treatment regimens for black liquor recovery boilers.

It is another object to mitigate utilization and distribution problems associated with fireside chemical introduction processes in black liquor recovery and like installations to maximize chemical efficiency for slag control.

A yet further, but related, object is to mitigate the costs resulting from the presence of slag by reducing its formation.

A yet further object is to increase furnace throughputs over time.

A still further object is to provide longer production runs with decreased downtime and easier cleanup.

It is yet another object of the invention to enable slag removal by chemical injection during normal operation of a furnace.

These and other objects are achieved by the present invention which provides an improved process for introducing fireside chemical additives into black liquor recovery boilers to achieve highly effective, reliable slag control treatments with reduced chemical consumption by effecting improved distribution of active slag-reducing chemicals, comprising: determining slagging locations within a furnace where slagging will occur in the absence of treatment; determining the temperature and gas flow conditions within the boiler; locating introduction points on the furnace wall where introduction of chemicals could be accomplished; based on the temperature and gas flow conditions existing between the introduction points and the slagging locations, determining the droplet size, amount of chemical, amount of water (or other medium) as a carrier, and droplet momentum necessary to direct the chemical in active form to the slagging locations; and, based on the determinations of the previous step, introducing chemical to reduce slagging.

BRIEF DESCRIPTION OF THE DRAWINGS

The invention will be better understood and its advantages will become more apparent when the following detailed description is read in conjunction with the accompanying drawings, in which.

BEST MODE FOR CARRYING OUT THE INVENTION

Figure 1:
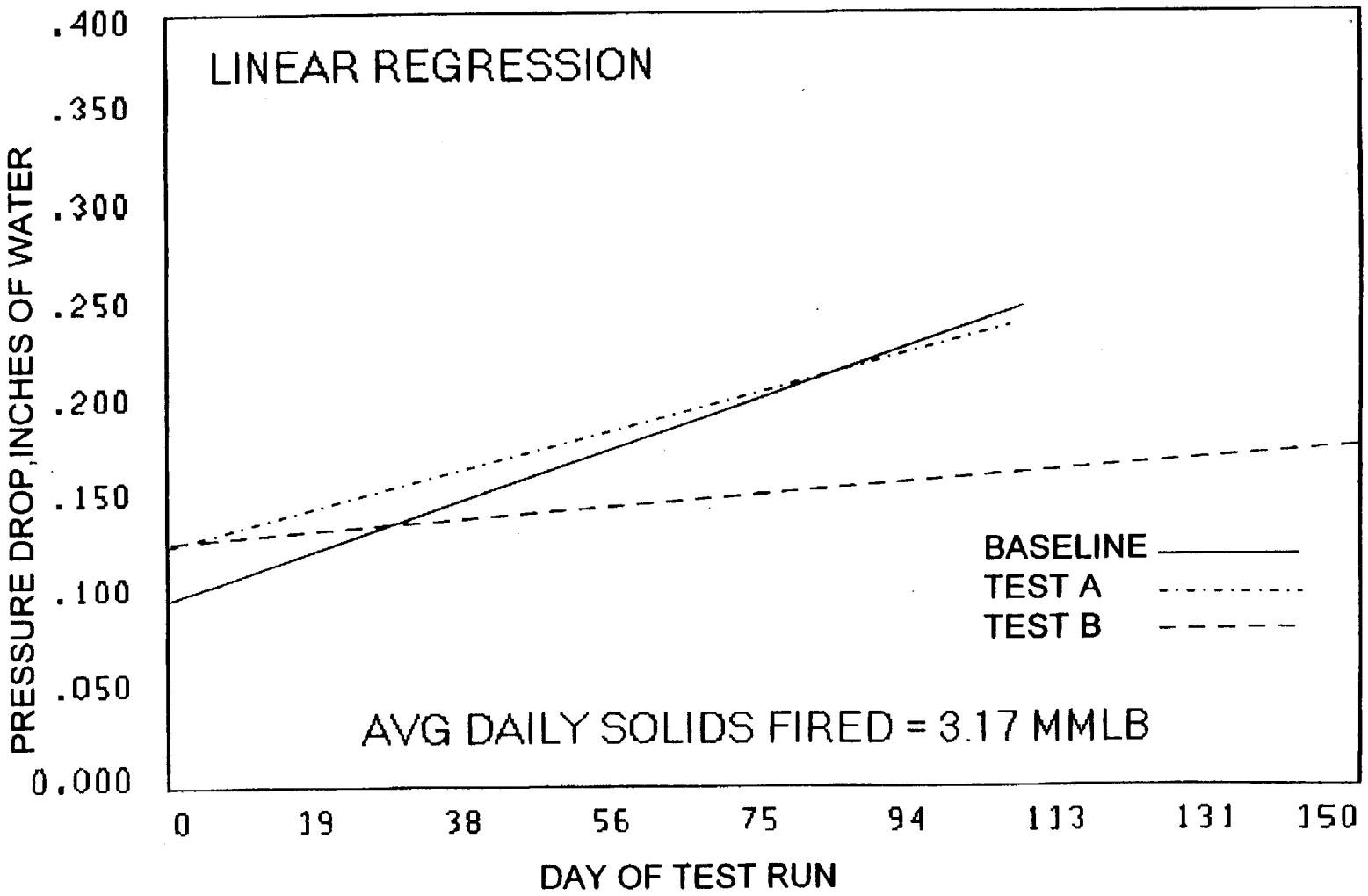
FIG. 1 is a graphical summary of a baseline run, a test run not in accord with the invention and a test run according to the invention.

The invention calls for determining the temperature, velocity and flow path of the hot combustion gases inside the furnace to determine temperature and flow profiles therein; determining the points within the furnace, through observation alone or with modeling, most subject to slagging; and based on this information, determining, for an aqueous treatment fluid, the best droplet size, momentum and reagent concentration, injection location and injection strategy to reach the points in the furnace most affected by slagging.

The temperatures can be determined by placing suction pyrometers, such as those employing a k-type thermocouple, at a sufficient number of locations within the furnace. The exact number and location of the thermocouples will at first be estimated based on past experience with boilers of the type being treated, and the initial determinations will then be modified based on the results achieved.

The velocities of the hot combustion gases within the boiler is determined at a sufficient number of locations to permit the use of a suitable computational fluid dynamics (CFD) modeling technique to establish a three-dimensional temperature profile. For applications involving future construction or where direct measurements are impractical, CFD modeling alone can sufficiently predict furnace conditions.

The injection locations into a near-wall zone, and the droplet velocity, size and concentration, are facilitated by computational fluid dynamics. For some applications, chemical kinetic modeling (CKM) techniques can enhance the design process. In reference to the CFD and CKM techniques, see the following publication and the references cited therein: Sun, Michels, Stamatakis, Comparato, and Hofmann, "Selective Non-Catalytic $NO_x$ Control with Urea: Theory and Practice, Progress Update", American Flame Research Committee, 1992 *Fall International Symposium*, Oct. 19–21, 1992, Cambridge, Mass.

A computational fluid dynamics software package called "PHOENICS" (Cham. LTD.), running on a Sun 4/110 Workstation, has been found effective. This program and others can solve a set of conservation equations in order to predict fluid flow patterns, temperature distributions, and chemical concentrations within cells representing the geometry of the physical unit. It has been found helpful to also run, in addition to the standard program features, a set of subroutines to describe flue gas properties and injector characteristics which for utilization in the solution of the equations.

The process units are approximated as a set of space-filling cells that adequately resemble their physical geometry. The number of cells is chosen to be great enough to provide the necessary details of the unit, but not so great as to require unacceptable data storage space or computational time. Anywhere from 40,000 to 300,000 cells are typically used, depending on the number of conserved quantities solved. The intricacies of the physical unit are included either by setting the porosities of individual cells or cell faces to values between 0 and 1 or by the use of cells that closely fit the actual geometry with body-fitted and/or molhblock methods. In this way it is possible to closely approximate the geometry of the process unit being modeled.

Cells corresponding to the locations of inlets or exits on the unit are assigned net mass sources which are positive for inflow or negative for outflow. Energy sources such as heat loss to a tube bundle or heat released during combustion are also specified for cells where appropriate. Chemical concentrations of different species are specified for mass entering a cell or for compositional changes due to reactions.

Numerical approximations for the conserved quantities are found by integrating the governing equations over each of the individual cells, resulting in a set of algebraic equations relating the average values within each cell to the fluxes between adjacent cells. The conserved quantities are the total mass, the mass of each independent chemical species, the total momentum, and the total energy. Special sources such as reactions or heat transfer are added to the flows through the cell faces to determine the total flow into or out of each cell. Once boundary and initial approximations for each variable are assigned, the total amount of conserved quantities flowing into and out of a cell from adjacent cells (using both convective and diffusive transport mechanisms) are determined. In a steady state solution, the net flow for a given cell is very close to zero; that is, the amount of a quantity flowing into a cell exactly equals the amount flowing out. If the solution is not at steady state, a net imbalance exists which causes an accumulation of mass, energy, or momentum in a cell. This accumulation produces a change in the flow and physical properties of the cell, and the new values are used as initial values for the next iteration. Iterations are performed until the total changes in properties are sufficiently small compared to their absolute values.

An appropriate equation of state is used to estimate flue gas density, and the thermal properties and viscosity of flue gas were estimated from published data. The heat capacity of flue gas is assumed to be constant, but is adjusted depending on the average moisture content for flue gas of the modeled unit.

The primary effect of turbulence is to greatly increase the rate of mass and energy dispersion, resulting in much larger transfer coefficients than in nonturbulent situations. One model, known as the k-epsilon model, has been widely used as an estimate of the effects of turbulent dispersion (see, for example, Launder, B. E., "Turbulence Models and Their Experimental Verification. 2. Two-Equation Models-I", Imperial College of Science and Technology, Rept. HTS/73/17,N7;4-12056, April 1973).

The heat released during combustion reactions can be modeled in several ways. In the most simple case, the heat is added as an enthalpy source in a boundary cell containing the mass inflow. Alternately, this heat is released in a set of cells covering the expected combustion zone. When possible, and preferably, the combustion process is modeled as a set of median combustion reactions, and can include particulate combustion. The chemical reaction model gives a more realistic combustion zone predictions and temperature estimates, but is very costly in terms of convergence, data storage, and total computational time. Consequently, combustion is usually approximated as occurring in a specified zone with the sources of heat and combustion products distributed throughout the volume.

Radiation is a primary heat transfer mechanism in furnaces, but is also very difficult to treat computationally. Because of the complexity of numerical treatment, radiation may not in some cases be specifically included in the model. Instead, heat transfer approximation to radiation can be included. The use of the model in accordance with the invention has yielded unexpectedly effective treatment regimens in terms of utilization of chemicals and effectiveness of the slag control. Indeed, the process of the invention in its preferred form will actually reduce slag deposits that have already developed. Heat transfer to internal tube bundles is modeled as a heat loss per unit volume over the cells corresponding to the bundle locations.

Typical sprays produce droplets with a wide range of sizes traveling at different velocities and directions. These drops interact with the flue gas and evaporate at a rate dependent on their size and trajectory and the temperatures along the trajectory. Improper spray patterns are typical of prior art slag reducing procedures and result in less than adequate chemical distributions and lessen the opportunity for effective treatment.

A frequently used spray model is the PSI-Cell model for droplet evaporation and motion, which is convenient for iterative CFD solutions of steady state processes. The PSI- Cell method uses the gas properties from the fluid dynamics calculations to predict droplet trajectories and evaporation rates from mass, momentum, and energy balances. The momentum, heat, and mass changes of the droplets are then included as source terms for the next iteration of the fluid dynamics calculations, hence after enough iterations both the fluid properties and the droplet trajectories converge to a steady solution. Sprays are treated as a series of individual droplets having different initial velocities and droplet sizes emanating from a central point. Correlations between droplet trajectory angle and the size or mass flow distribution are included, and the droplet frequency is determined from the droplet size and mass flow rate at each angle.

For the purposes of this invention, the model should further predict multi component droplet behavior. The equations for the force, mass, and energy balances are supplemented with flash calculations, providing the instantaneous velocity, droplet size, temperature, and chemical composition over the lifetime of the droplet. The momentum, mass, and energy contributions of atomizing fluid are also included.

The correlations for droplet size, spray angle, mass flow droplet size distributions, and droplet velocities are found from laboratory measurements using laser light scattering and the Doppler techniques. Characteristics for many types of nozzles under various operating conditions have been determined and are used to prescribe parameters for the CFD model calculations.

When operated optimally, chemical efficiency is increased and the chances for impingement of droplets directly onto heat exchange and other equipment surfaces is greatly reduced.

The slag-reducing agent is most desirably introduced as an aqueous treatment solution, a slurry in the case of magnesium oxide or magnesium hydroxide. The concentration of the slurry will be determined as necessary to assure proper direction of the treatment solution to the desired area in the boiler. Typical concentrations are from about 51 to about 80% active chemical by weight of the slurry, preferably from about 5 to about 30%. Other effective metal oxides and hydroxides (e.g., copper, titanium and blends) are known and can be employed.

The total amount of the slag-control reagent injected into the combustion gases from all points should be sufficient to obtain a reduction in the rate of slag build-up of the frequency of clean-up. The build-up of slag results in increased pressure drop through the furnace, e.g., through the generating bank. Typical treatment rates will be from about 0.1 to about 10 pounds of chemical for each ton of black liquor solids or other waste. Preferred treatment rates will be within the range of from about 0.5 to about 5 pounds per ton of liquor solids. Dosing rates can be varied to achieve long-term slag formation control or at higher rates to actually reduce slag deposits.

One preferred arrangement of injectors for introducing active chemicals for reducing slag in accordance with the invention employ multiple levels of injection to best optimize the spray pattern and assure targeting the chemical to the point that it is needed. However, the invention can be carried out with a single zone, e.g., in the upper furnace, where conditions permit or physical limitations dictate. Typically, however, it is preferred to employ multiple stages, or use an additive in the fuel and the same or different one in the upper furnace. This permits both the injection of different compositions simultaneously or the introduction of compositions at different locations or with different injectors to follow the temperature variations which follow changes in load.

Average droplet sizes within the range of from 20 to 600 microns are typical, and most typically fall within the range of from about 100 to about 300 microns. And, unless otherwise indicated, all parts and percentages are based on the weight of the composition at the particular point of reference.

EXAMPLE

A North American pulp and paper mill firing 1.47 million kgs per day of black liquor dry solids (69–71% solids) in their recovery boiler was experiencing severe superheater and generating bank fireside fouling. This slag buildup resulted in:

- production shutdowns caused by INCREASING pressure drops that prevented the unit from getting the necessary through-put;
- increased liquor swapping because of limited burning capacity;
- substantial loss of BTU's going out of the stack as slag retarded heat transfer at an INCREASING rate as the production run progressed toward a shutdown for cleaning.

Applying the targeted in-furnace injection program according to the invention to the recovery boiler (producing 309,091 kg/hr steam @6201 kPa) was effective in eliminating all of the above problems. This was accomplished by injecting a liquid reagent directly into the upper furnace. The injection locations were determined by a computational fluid dynamics computer model.

Normally, this facility would have production runs limited to approximately four months on soft wood before it would have to shut down. Soot blowers were normally used to control this build-up, but they lost their effectiveness as deposits built and hardened further. Thermal sheds (bringing the boiler down from high load to low load and then ramping back up) were effective early on after a shutdown while the boiler was still relatively clean, but lost their effectiveness as the campaign progressed.

During a baseline, untreated production run (just after unit cleaning), the pressure drop through the generating bank would increase from 0.1 inches $H_2O$ pressure differential to 0.3 inches $H_2O$ at which point the unit was shut down for water washing. To retard this INCREASING pressure drop due to slagging, the plant utilized thermal sheds, at regular intervals (6–7 days) to try and clear the tube passages. Early in the run, this procedure would reduce the pressure drop, but as time went on they became less effective and were unable to extend the run beyond 120 days as the slag buildup became too severe.

FIG. 1 shows regression lines for this baseline run along with one test run (A) not in accord with the invention and one (B) according to the invention. In test run (A), modeling was attempted but not completed and injection locations were not optimized. The treatment liquid was a slurry without necessary control of droplet size and velocity necessary to achieve optimum targeting. In test run (B), the invention was employed with highly effective results.

Test run (A) began with four injectors. As compared to the baseline, this run resulted in a boiler that remained below the maximum permissible generating bank pressure differential at the time it would usually be taken out of service. At about day 53, the treatment rate was increased. Without proper droplet size and velocity control, the additional reagent did not significantly improve results. At day 120, the regression line passes the value of approximately 0.25 inches. Near the end of this run, the two additional injectors were installed.

Early, normal shutdown was avoided by the use of chemical and a modified "chill and blow" maintained operation. However, it was clear that further improvement was required. The results of test run (A) are also shown in FIG. 1. In run (B) began six injectors were in use, and the unit ran for over 150 days with the thermal sheds now being highly effective at cleaning heat transfer surfaces. As previously mentioned, these would work well when the boiler was clean, but their effectiveness decreased rapidly as the boiler fouled. The difference in this run was that the thermal sheds retained its effectiveness and even reversed the fouling trend downward.

The results of test run (B) are also shown FIG. 1. This regression line is quite flat, indicating considerably less fouling even after over 150 days. The boiler was brought down in a plant-wide shutdown to hook up a new water treatment facility; but it did not have to be brought down due to excessive fouling. When the boiler came down for a general plant shutdown, inspection revealed much cleaner tube surfaces. With the targeted in-furnace injection program, the condition of the boilers changed dramatically. The tube surfaces were able to be cleaned in less than 12 hours.

Figure 2:
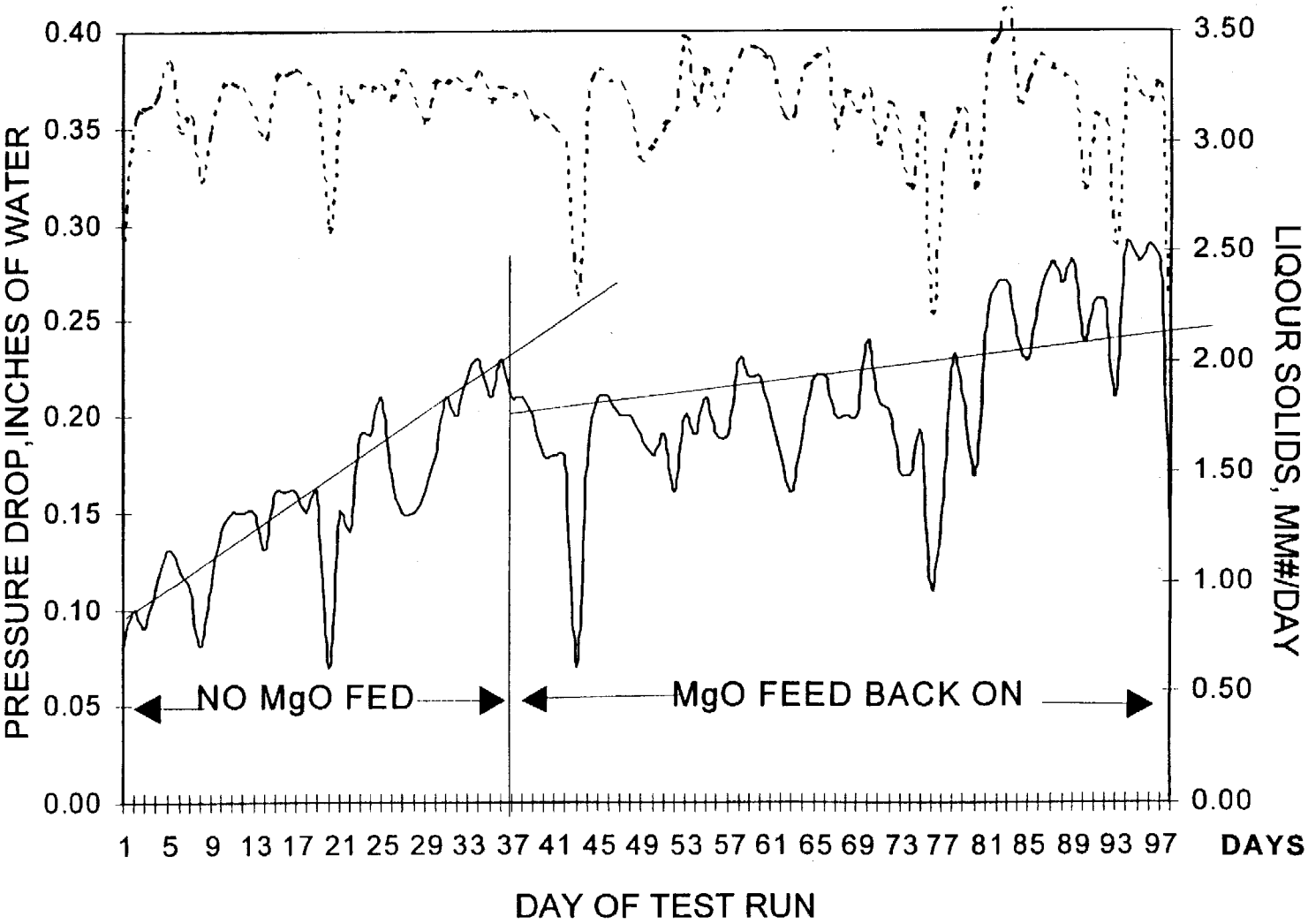
FIG. 2 is a graphical summary of another test run according to the invention.

A recent production run was planned to last three months and since the run was that short, the reagent was not fed. A second purpose was to see if mechanical improvements, such as perimeter firing, could eliminate the need for chemicals. However, after only one month into the run, the pressure drops had increased so much that a shutdown was imminent, so the reagent was turned back on. After feed was restored, the generating bank furnace pressure differential leveled off. Injection rates of chemical were reduced one-third and thermal sheds have been cut back 75%. The results of this run are shown in FIG. 2.

The above description is for the purpose of teaching the person of ordinary skill in the art how to practice the invention. It is not intended to detail all of those obvious modifications and variations which will become apparent to the skilled worker upon reading the description. It is intended, however, that all such obvious modifications and variations be included within the scope of the invention which is defined by the following claims. The claims are meant to cover the claimed components and steps in any sequence which is effective to meet the objectives there intended, unless the context specifically indicates the contrary.

We claim:

1. A process for reducing the buildup of slag in a black liquor recovery boiler, comprising:

determining slagging locations within a furnace where slagging will occur in the absence of treatment;

determining the temperature and gas flow conditions within the boiler;

locating introduction points on the furnace wall where introduction of chemicals could be accomplished;

based on the temperature and gas flow conditions existing between the introduction points and the slagging locations, determining the droplet size, amount of treatment chemical, amount of water as a carrier, and droplet momentum necessary to direct the chemical in active form to the slagging locations; and, based on the determinations of the previous step, introducing chemical to reduce slagging.

2. A process according to claim 1 wherein the treatment chemical is a slurry of magnesium oxide or magnesium hydroxide.

3. A process according to claim 1 wherein the concentration of the chemical in the slurry is within the range of from about 1 to about 80%.

4. A process according to claim 1 wherein the chemical is introduced into the furnace at a dosage rate of from about 0.5 to about 5 pounds per ton black liquor solids burned in the furnace.

5. A process according to claim 4 wherein chemicals are introduced at more than one elevation.

6. A process for cleaning a combuster of of slag buildup, comprising:

determining slagging locations within a furnace where slagging will occur in the absence of treatment;

determining the temperature and gas flow conditions within the combuster;

locating introduction points on the furnace wall where introduction of chemicals could be accomplished;

based on the temperature and gas flow conditions existing between the introduction points and the slagging locations, determining the droplet size, amount of treatment chemical, amount of carrier for the chemical, and droplet momentum necessary to direct the chemical in active form to the slagging locations; and, based on the determinations of the previous steps, introducing chemical.

7. A process according to claim 6 wherein the treatment chemical is a slurry of metal oxide or hydroxide.

8. A process according to claim 7 wherein the concentration of the chemical in the slurry is within the range of from about 1 to about 80%.

9. A process according to claim 8 wherein the chemical is introduced into the furnace at a dosage rate of from about 0.1 to about 10 pounds per ton black liquor solids burned in the furnace.

10. A process according to claim 6 wherein chemicals are introduced at more than one elevation.

* * * * *